US007481272B2

(12) United States Patent
Mackay

(10) Patent No.: US 7,481,272 B2
(45) **Date of Patent: *Jan. 27, 2009**

(54) COMPLETION APPARATUS AND METHODS FOR USE IN WELLBORES

(75) Inventor: Alexander Craig Mackay, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/751,276

(22) Filed: May 21, 2007

(65) Prior Publication Data

US 2007/0261846 A1 Nov. 15, 2007

Related U.S. Application Data

(63) Continuation of application No. 11/295,678, filed on Dec. 6, 2005, now Pat. No. 7,219,745, which is a continuation of application No. 10/681,426, filed on Oct. 8, 2003, now Pat. No. 6,971,450, which is a continuation of application No. 09/918,002, filed on Jul. 30, 2001, now Pat. No. 6,655,459.

(51) Int. Cl.
*E21B 43/10* (2006.01)

(52) U.S. Cl. ..... 166/177.4; 166/242.8

(58) Field of Classification Search ..... 166/285, 166/177.4, 207, 384, 242.8
See application file for complete search history.

(56) References Cited

U.S. PATENT DOCUMENTS

| | | | | |
|---|---|---|---|---|
| 6,039,120 | A * | 3/2000 | Wilkins et al. | 166/368 |
| 6,655,459 | B2 * | 12/2003 | Mackay | 166/285 |
| 6,845,820 | B1 * | 1/2005 | Hebert et al. | 166/285 |
| 6,971,450 | B2 * | 12/2005 | Mackay | 166/384 |
| 7,219,745 | B2 * | 5/2007 | Mackay | 166/380 |
| 2003/0116318 | A1 * | 6/2003 | Metcalfe | 166/285 |

* cited by examiner

*Primary Examiner*—William P Neuder
(74) *Attorney, Agent, or Firm*—Patterson & Sheridan, LLP

(57) ABSTRACT

An apparatus and methods for preventing the accumulation of unwanted materials in an enlarged inner diameter portion of a casing or housing. In one aspect of the invention, a sleeve is disposed in the housing to isolate an annular area defined by the outer surface sleeve and the wall of the enlarged inner diameter portion. The sleeve prevents unwanted materials from being disposed in the annular area. The sleeve can later be expanded into the enlarged inner diameter portion, removed from the wellbore or destroyed. In another aspect of the invention, the sleeve is provided and disposed to cover the enlarged inner diameter portion. By covering the enlarged inner diameter portion, unwanted material is prevented from accumulating at said portion and from interfering with the expansion of the next casing into said portion to form a monobore. The sleeve can be made from materials that are dissolvable, elastically deformable, or retrievable.

20 Claims, 5 Drawing Sheets

COMPLETION APPARATUS AND METHODS FOR USE IN WELLBORES

CROSS-REFERENCE TO RELATED APPLICATIONS

This application is a continuation of U.S. patent application Ser. No. 11/295,678, filed Dec. 6, 2005 now U.S. Pat. No. 7,219,745, which is a continuation of U.S. patent application Ser. No. 10/681,426, filed Oct. 8, 2003, now U.S. Pat. No. 6,971,450, which application is a continuation of U.S. patent application Ser. No. 09/918,002, filed Jul. 30, 2001, now U.S. Pat. No. 6,655,459, which applications are herein incorporated by reference in their entirety.

BACKGROUND OF THE INVENTION

1. Field of the Invention

The present invention provides an apparatus and methods for use in wellbores. More particularly, the invention provides an apparatus and methods for use with a cement shoe assembly having an isolation sleeve for use in monobore wells. Even more particularly, the invention provides a cement shoe assembly with an enlarged inner diameter portion and a sleeve for isolating the enlarged portion from the bore of the cement shoe, thereby facilitating the expansion of a tubular into the enlarged portion after cementing. The invention also provides an isolation sleeve for use with a casing in a monobore well.

2. Description of the Related Art

In the drilling of a hydrocarbon well, a wellbore is formed using a drill bit that is urged downwardly at a lower end of a drill string. After drilling a predetermined depth, the drill string and bit are removed and the wellbore is lined with a string of tubulars or casing. The casing is subsequently cemented, thereby protecting the formation and preventing the walls of the wellbore from collapsing. The casing also provides a reliable path through which drilling tools, drilling mud, and ultimately, production fluid may travel.

After the wellbore is lined with the initial string of casing, the well is drilled to a new depth. A new string of tubulars or liner is then lowered into the well. The new liner is positioned so that the top of the liner overlaps the bottom of the existing casing. Thereafter, with the liner held in place with a mechanical hanger, the liner is cemented. In cementing a tubular string, a column of cement is pumped into the tubular and forced to the bottom of the wellbore where it flows out and flows upward into an annulus defined by the wellbore and the new string of liner.

In order to facilitate cementing of a tubular string in a well, a cementing apparatus referred to as a cement shoe may be lowered into the wellbore at the bottom of the tubular string to be cemented. The shoe typically includes various components including a tapered nose portion located at the downhole end of the tubular to facilitate insertion of the shoe into the borehole. Additionally, a check valve constructed and arranged to partially seal the end of the tubular is provided. The check valve prevents entry of well fluid during run-in while permitting cement to subsequently flow outwards. The same valve or another valve or plug typically located in a baffle collar above the cementing apparatus prevents the cement from back flowing into the tubular. Components of the cementing shoe are made of fiberglass, plastic, or other drillable material. Once the cementing is completed, the shoe and any cement remaining in the casing can later be destroyed when the wellbore is drilled to a new depth.

Recently, an apparatus has been developed for expanding the diameter of a liner in a wellbore to conform to the larger diameter of a previously run casing string. FIG. 1 is an exploded view of an exemplary expansion tool 700. The expansion tool 700 has a body 702 which is hollow and generally tubular with connectors 704 and 706 for connection to other components (not shown) of a downhole assembly. The connectors 704 and 706 are of a reduced diameter compared to the outside diameter of the longitudinally central body part of the tool 700. The central body part has three recesses 714 to hold a respective roller 716. Each of the recesses 714 has parallel sides and extends radially from a radially perforated tubular core (not shown) of the tool 700. Each of the mutually identical rollers 716 is somewhat cylindrical and barreled. Each of the rollers 716 is mounted by means of an axle 718 at each end of the respective roller and the axles are mounted in slidable pistons 720. The rollers are arranged for rotation about a respective rotational axis, which is parallel to the longitudinal axis of the tool 700, and radially offset therefrom at 120-degree mutual circumferential separations around the central body. The axles 718 are formed as integral end members of the rollers 716 and the pistons 720 are radially slidable, one piston 720 being slidably sealed within each radially extended recess 714. The inner end of each piston 720 is exposed to the pressure of fluid within the hollow core of the tool 700 by way of the radial perforations in the tubular core. In this manner, pressurized fluid provided from the surface of the well, via a tubular, can actuate the pistons 720 and cause them to extend outward and to contact the inner wall of a tubular to be expanded. Additionally, at an upper and a lower end of the expansion tool 700 are a plurality of non-compliant rollers 703 constructed and arranged to initially contact and expand the tubular prior to contact between the tubular and fluid actuated rollers 716. Unlike the compliant, fluid actuated rollers 716, the non-compliant rollers 703 are supported only with bearings and they do not change their radial position with respect to the body portion of the tool 700.

Historically, each string of tubulars inserted to line a wellbore has necessarily been smaller in diameter than the string previously inserted. In this respect, the wellbore typically consists of sequential strings of tubulars of an ever-decreasing inner and outer diameter. The ability to expand a tubular in situ has led to the idea of monobore wells, wherein through the expansion of entire tubular strings in the wellbore, the wellbore remains at about the same inner diameter throughout its length. The advantages of the monobore well are obvious. The tubulars lining the borehole, and therefore, the possible path for fluid in and out of the well remains consistent regardless of well depth. Additionally, wellbore components and other devices can more easily be run into the well without regard for the restriction of decreasing diameters of the lining encountered on the way to the bottom of the wellbore. One problem with monobore wells relates to the difficulty of expanding one tubular into another when the outer tubular is cemented into the wellbore, preventing the outer diameter from increasing as the inner tubulars is expanded into it.

In order to facilitate the assembly of tubular strings to form a monobore, the lower portion of the upper string of tubulars is specifically designed with an enlarged inner diameter in the area that will receive the expanded upper portion of a lower string. To join the tubulars with an expansion means, the upper end of the second string is aligned with the enlarged inner diameter portion of the first string. An expansion tool is used to radially expand the upper end of the second string into the enlarged inner diameter portion to approximately the same inner and outer diameter as the first string. In this manner, the second tubular string is expanded into the first string without an increase in the outer diameter of the first string and without the use of conventional slips.

In an example of the above-described design, a cement shoe is built into the lower portion of the first string of tubulars. The housing of the shoe has an enlarged inner diameter portion as discussed above. After the cement shoe is used to cement the tubular string in the wellbore, the interior portions of the shoe are drilled out as a new borehole is formed therebelow. Subsequently, a second string of tubulars is run into the new section of borehole, and the upper portion of the second string of tubulars is expanded into the enlarged inner diameter portion of the first string as described herein.

Because of the enlarged inner diameter portion of the first string, subsequent drilling of the cement shoe is usually inadequate to remove some residual material from the lower portion of the string. The material typically remains around the inside wall of the enlarged inner diameter portion because the outer diameter of the drill bit does not reach it. The residual material can interfere with the connection between the upper end of the next string of tubulars and the lower end of the existing string. Additionally, the residual material may extend into the bore and interfere with wellbore components that are run-in into the wellbore.

A need, therefore, exists for an apparatus and method to more efficiently prevent the accumulation of residual material in a tubular prior to connection to another tubular by expansion. There is a further need for a cement shoe that can be used in a tubular string without leaving residual material in an enlarged inner diameter portion of the string. There is a yet a further need for a cement shoe with an enlarged inner diameter portion and a method and apparatus for temporarily isolating the enlarged inner diameter portion from residual material.

SUMMARY OF THE INVENTION

The present invention generally provides an apparatus and methods to prevent unwanted materials such as cement from accumulating in a lower portion of a tubular having an enlarged inner diameter portion. A cement shoe assembly is provided at a lower end of a tubular string with a sleeve co-axially disposed therein to cover the enlarged inner diameter portion of the tubing. The sleeve serves to temporarily make the diameter of the tubular uniform and to isolate an annular area between the outside of the sleeve and the inner wall of the casing. A method of preventing accumulation of unwanted materials by disposing a sleeve in the enlarged inner diameter portion and later expanding the sleeve into said portion is provided. In one embodiment the sleeve is dissolvable. In another embodiment, a deformable sleeve with at least one internal ring is provided to cover the enlarged inner diameter portion. In still another embodiment, the sleeve is retrievable from the surface of the well.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective aspect or embodiments.

DETAILED DESCRIPTION OF THE PREFERRED EMBODIMENT

Figure 1:
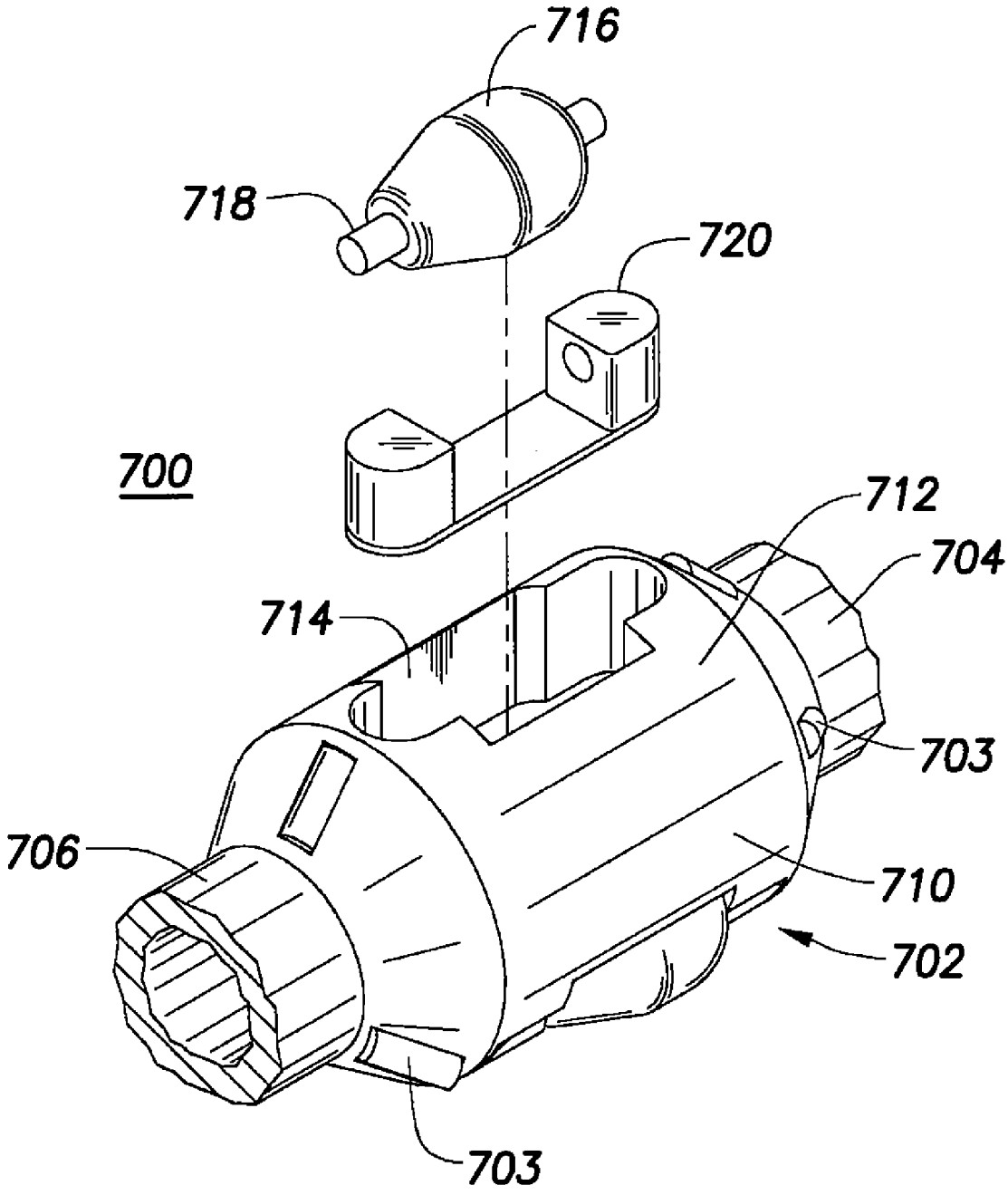
FIG. 1 is an exploded view of an exemplary expansion tool.
Figure 2:
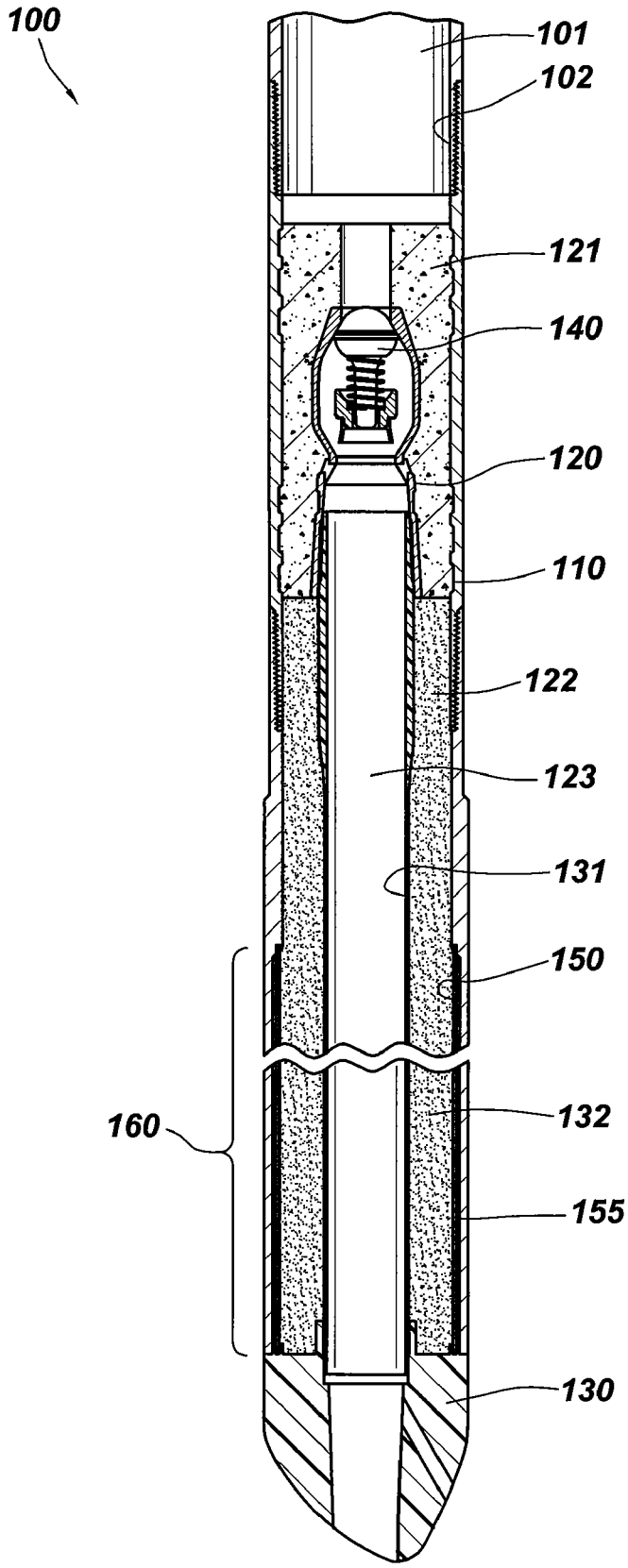
FIG. 2 is a cross-sectional view of a cement shoe assembly disposed at a lower end of a tubular and having a housing that includes an enlarged inner diameter portion at a lower end.

FIG. 2 is a cross-sectional view of a cement shoe assembly 100 disposed at a lower end of a tubular 101 and having a housing 110 that includes an enlarged inner diameter portion 160 at a lower end. The assembly 100 is typically disposed at a lower end of a string of tubulars that is run into a well and cemented. The cement isolates the wellbore from the formation therearound and prevents the wellbore from collapsing. The assembly 100 is preferably connected to a tubular 101 by a threaded connection 102 formed therebetween. The cement shoe assembly 100 includes a drillable shoe portion 120 disposed within the housing 110. The drillable shoe portion 120 includes a longitudinal bore 123 extending through the center of the cement shoe assembly 100 and provides a fluid path for the cement. The bore 123 communicates with the tubular 101 through a biased, one way valve 140 disposed at the upper end of the bore 123. The valve 140 permits fluid to enter the assembly 100 but prevents well fluids from passing from the wellbore and up into the tubular 101.

Adjacent valve 140, an annular area 121 defined between the bore 123 and the housing 110 is filled with concrete to stabilize the bore 123. Lining the bore 123 between the valve 140 and a conical nose portion 130 is a tubular 131. The conical nose portion 130 serves to facilitate the insertion of the assembly 100 into the wellbore. Adjacent the tubular 131, an annular area 132 between the cement shoe tubular and the housing 110 is filled with sand 122 or some other aggregate.

Figure 4:
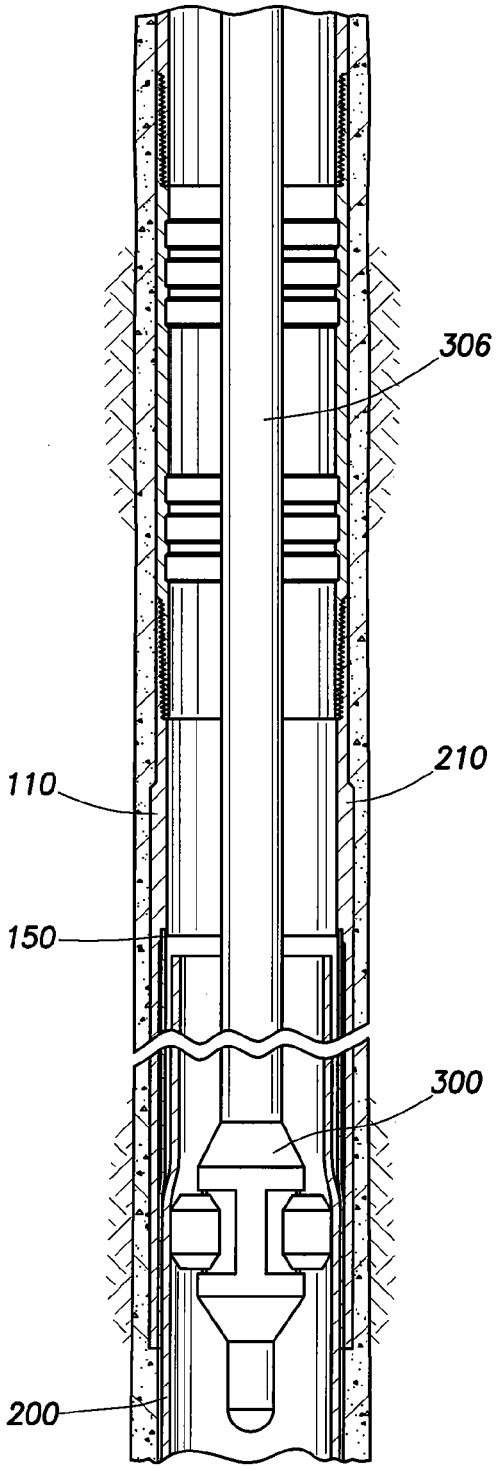
FIG. 4 is a section view showing the tubular and cement shoe housing cemented in a wellbore and a second tubular partially expanded into the enlarged inner diameter portion.

The housing 110 of the cement shoe assembly 100 includes an enlarged inner diameter portion 160 at a lower end. The enlarged inner diameter portion 160 has an inner diameter which is greater than the inner diameter of the upper section of the housing 110 and of the tubular 101 thereabove. The enlarged inner diameter portion 160 is configured to receive the top portion of a lower string of tubulars 200 (FIG. 4).

A sleeve 150 is co-axially disposed in the housing 110 and covers the enlarged inner diameter portion 160 to isolate the annular area formed between the inner surface of the enlarged inner diameter portion 160 and the outer surface of the sleeve 150. With the sleeve 150 in place, the inner diameter of the housing 110 is constant and is substantially the same diameter as the tubular 101 thereabove. The constant inner diameter ensures that the cement shoe material is removed as a drill bit passes through the housing 110. The sleeve 150 may be assembled with the cement shoe assembly 100 prior to run-in or the sleeve 150 may be installed downhole with a run-in tool.

Figure 3:
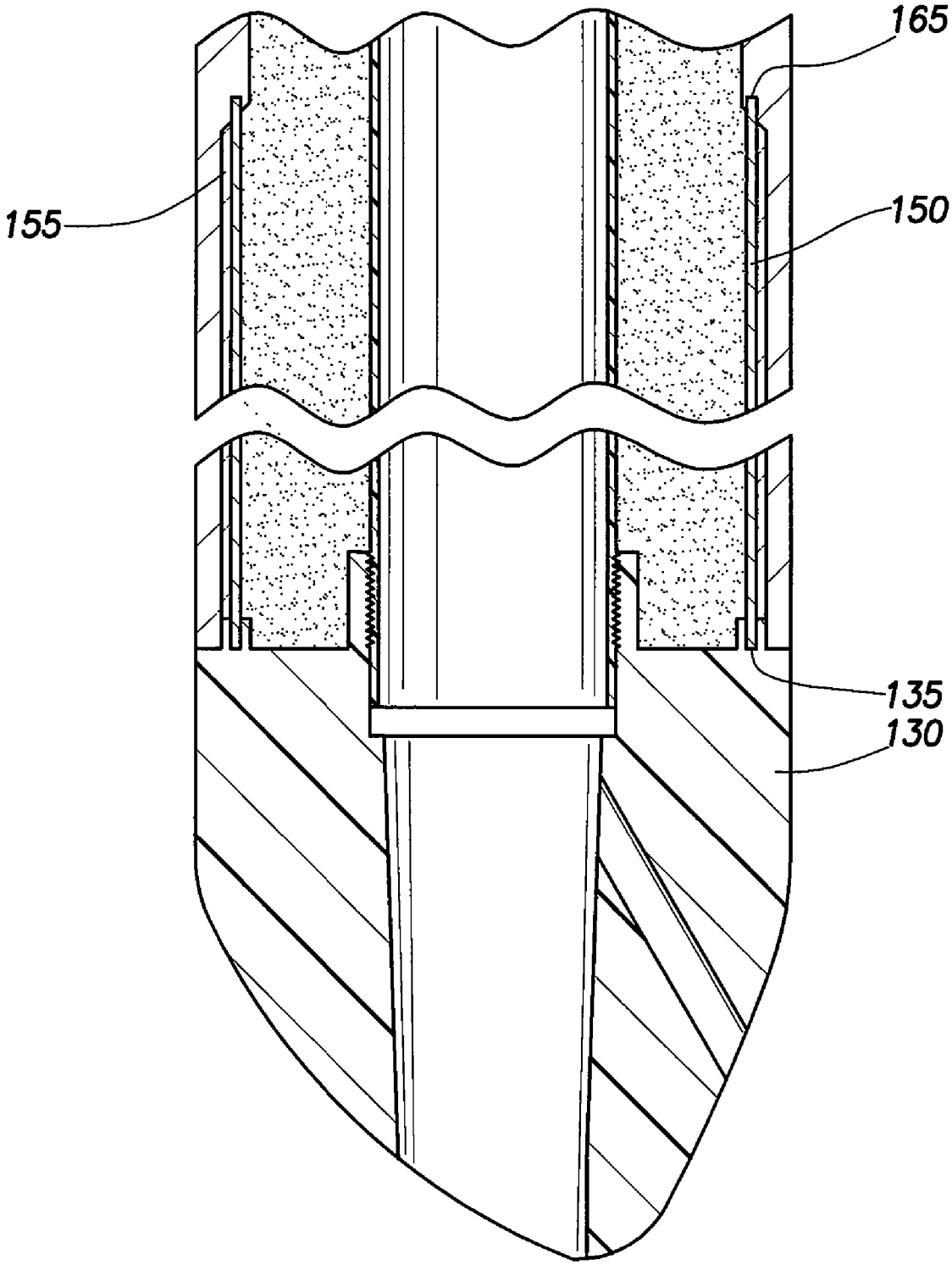
FIG. 3 is an enlarged view of the enlarged inner diameter portion of the cement shoe assembly.

FIG. 3 is an enlarged view of the enlarged inner diameter portion 160 of the cement shoe assembly 100. The sleeve 150 is coupled to the housing 110. The enlarged inner diameter portion 160 of the housing 110 has a recess 165 on its upper most end. The recess 165 is constructed to receive an upper end of the sleeve 150. At the top surface of the conical nose portion 130, a second recess 135 is provided to receive a lower end of the sleeve 150. The sleeve 150 may be frictionally attached or attached by a coupling means to the housing 110. The coupling means may be a rivet, screw, glue or other connector that can hold the sleeve 150 in place. The sleeve 150 is also shown forming the annular area 155 with the housing 110.

In an alternative embodiment, the sleeve 150 may be used to temporarily seal the annulus 155. The sleeve at its lower end has a flange (not shown) that is bent towards enlarged inner diameter portion 160, thereby forming a seal. The seal may have an aperture therein to allow the annular area 155 to equalize pressure as the cement shoe assembly 100 is run into the wellbore. Additionally, the annular area 155 may be filled with a fluid to prevent unwanted materials from accumulating in the annular area 155. The fluid may be a polymer, gel, foam, oil, or other fluid that is displaceable from the annular area 155 when the sleeve 150 is expanded into the enlarged inner diameter portion 160. The annular area 155 is filled with the fluid at the surface during assembly of the sleeve 150 with the housing 110.

In the cementing operation, the cement shoe assembly 100 is inserted into the wellbore on a string of tubulars. Thereafter, cement is injected and exits the bottom of the assembly 100. The cement is then forced up an annular area formed between the outer surface of the assembly 100 and the formation therearound by a column of fluid. The cement is then allowed to cure. With the addition of the sleeve 150, the enlarged inner diameter portion 160 has essentially the same inner diameter as the housing 110 and the tubular string. Subsequently, a drilling tool is run into the wellbore inside of the tubular 101 and the drillable shoe portion 120 and conical nose portion 130 are drilled up and destroyed, leaving only the housing 110 and the sleeve 150. The sleeve 150 is not destroyed because the outer diameter of the drill bit is slightly smaller than the inner diameter of the sleeve 150. Because the sleeve 150 is in place, the drill bit is able to drill out the cement or other unwanted materials in all sections of the housing 110.

After the shoe portion 120 is drilled out, the housing 110 originally used to house the components of the cement shoe assembly 100, becomes a part of the upper string of a tubulars 210. A new string of tubulars 200 (FIG. 4) having a smaller diameter is inserted into the wellbore as in prior art methods. The new string 200 has a smaller outer diameter than the inner diameter of the upper string 210 and the cement housing 110 in order to be inserted therethrough the upper string 210. Because the upper portion of the housing 110 is non-expandable, the cement shoe assembly 100 with sleeve 150 of the present invention would typically only be used at the end of the first string of tubulars inserted into a well. Thereafter, some other means of facilitating a cement job would be employed. In one example, a cement shoe could be "pumped down" a tubular and any potential expansion problems are avoided.

FIG. 4 is a section view showing the tubular 210 and cement shoe housing 110 cemented in a wellbore and a second tubular 200 partially expanded into the enlarged inner diameter portion. The top of the new string of tubulars 200 is shown aligned with the enlarged inner diameter portion 160 and the sleeve 150. The expansion tool 300 is used to expand the new string of tubulars 200 into the enlarged inner diameter portion 160 of the housing 110 so as to form a monobore and fix the tubulars in a sealing relationship. The expansion tool 300 operates with pressurized fluid supplied through run-in string 306. The expansion tool 300 is shown in an actuated position and is expanding the diameter of the new string of tubulars 200 into the enlarged inner diameter portion 160 of housing 110 along with the sleeve 150. Typically, the expansion tool 300 rotates as the rollers 304 are actuated and the tool 300 is urged upwards in the wellbore. The expansion tool 300 can also be urged downward to expand the new string of tubulars 200. In this manner, the expansion tool 300 can be used to enlarge the diameter of new string of tubulars 200 circumferentially to a uniform size.

When the new string of tubulars 200 is expanded, the sleeve 150 is also expanded into the enlarged inner diameter portion 160. The new string of tubulars 200 and the sleeve 150, when expanded together into the enlarged inner diameter portion 160, will have the same inner diameter as tubular 101 thereabove, thereby forming a monobore. Thus, the sleeve 150 becomes seamlessly "sandwiched" between the new tubular 200 and the enlarged inner diameter portion 160 of the housing 110. While the upper portion of the housing 110 is not expandable, subsequent tubular strings will be of an outer diameter making it possible for the strings to be inserted through the housing and subsequently expanded to a greater diameter.

Figure 5:
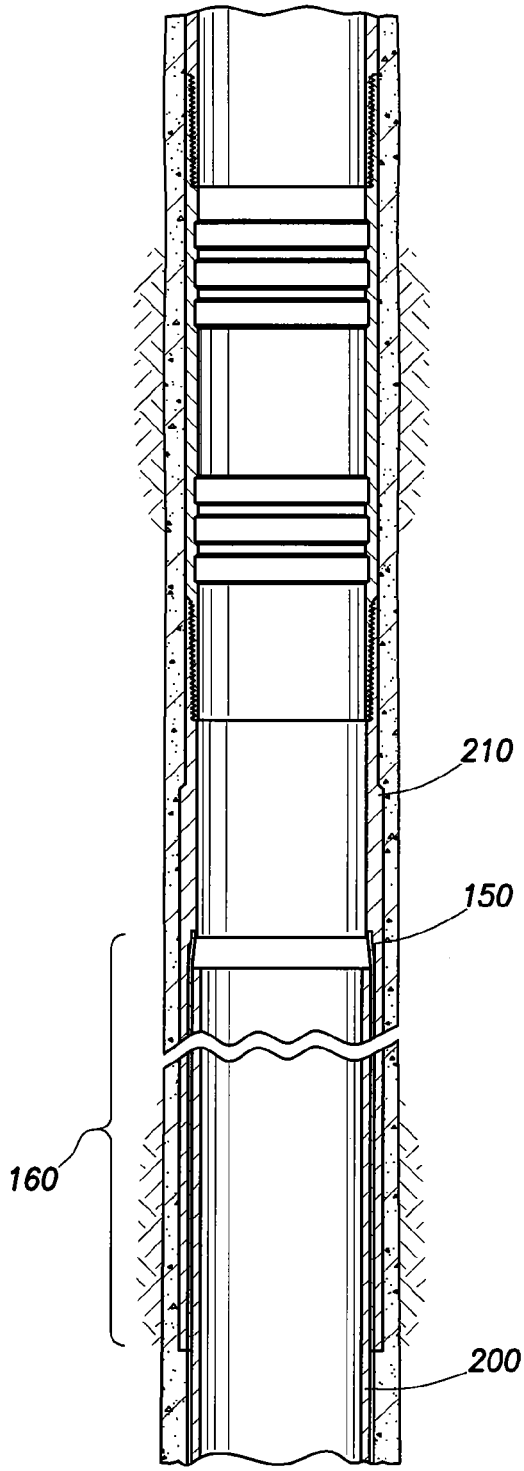
FIG. 5 is a section view showing an upper portion of a second tubular completely expanded into the enlarged inner diameter portion.

FIG. 5 is a section view showing an upper portion of a second tubular 200 completely expanded into the enlarged inner diameter portion 160. The FIG. 5 shows the relative position of the new tubular 200 and the sleeve 150 after being expanded by the expansion tool 300 into the enlarged inner diameter portion 160. By expanding the new tubular 200 and the sleeve 150 into the enlarged inner diameter portion 160 of housing 110, the inner diameter of new tubular 200 is aligned with the enlarged inner diameter portion of the housing 110.

In an alternative embodiment, the sleeve 150 may be manufactured from a dissolvable material such as aluminum, zinc, magnesium, or composite material such as carbon fiber. The dissolvable material must be able to withstand the acidic conditions and temperatures found in wellbores and be strong enough to withstand physical abuse by downhole tools and fluids during the cementing process. The dissolvable material is dissolvable by a dissolving fluid such as benzene, acetone, acids such as hydrochloric acid, sulfuric acid, phosphoric acid, hydrofluoric acid, or similar fluid. The dissolving fluid however, must not be strong enough to dissolve the cement, and damage the tubulars or wellbore components.

Figure 6:
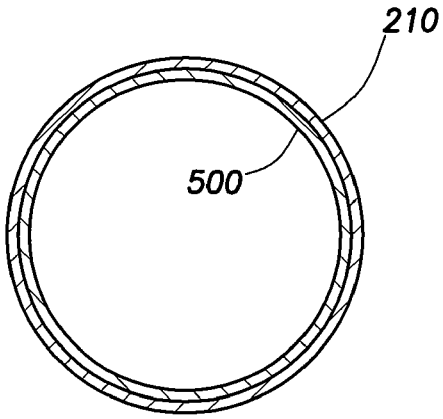
FIG. 6 is a top section view showing a temporarily expanded piece of patch casing co-axially disposed in the cement shoe housing.
Figure 7:
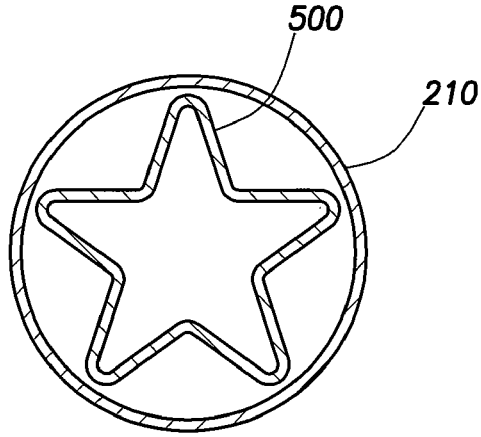
FIG. 7 illustrates the patch casing in a collapsed position.
Figure 8:
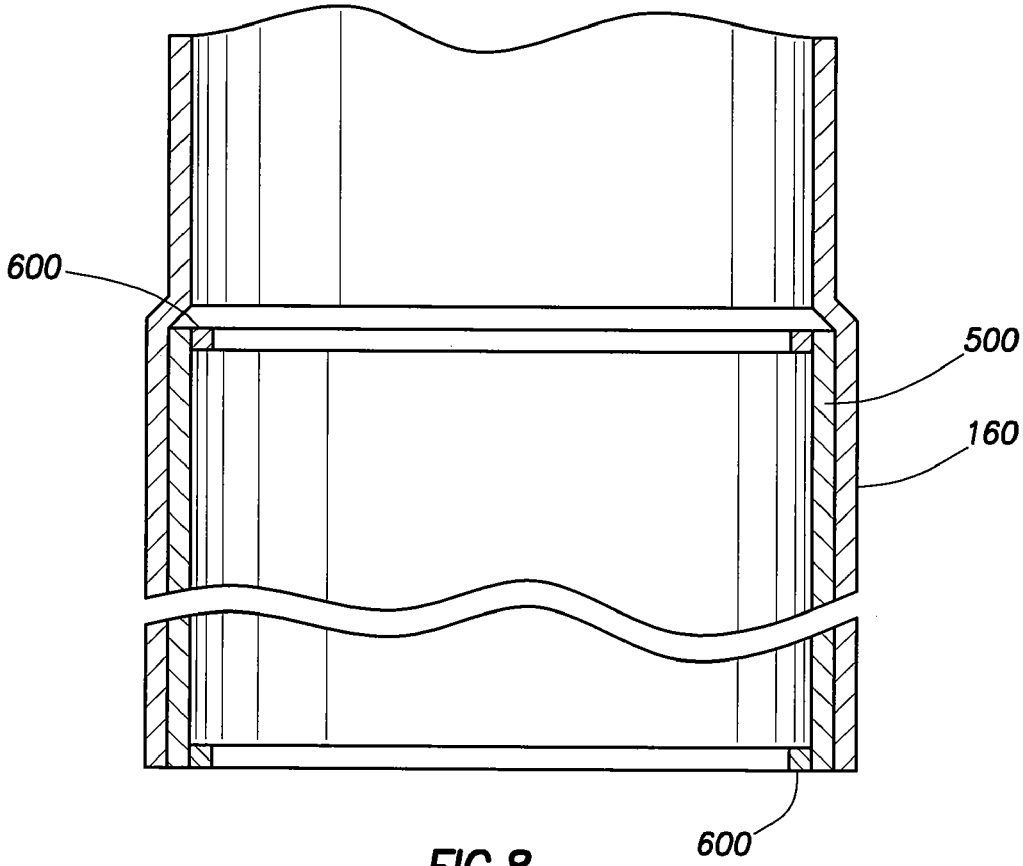
FIG. 8 is a section view of the patch casing disposed in the enlarged inner diameter portion.

In another alternative embodiment, a retrievable or drillable piece of patch casing may be used as the sleeve 150. FIG. 6 is a top section view showing a temporarily expanded piece of patch casing 500 co-axially disposed in the cement shoe housing 110. The patch casing 500 is a piece of tubing made from elastically deformable materials (FIG. 7 shows normal state). The patch casing 500 is sized for the length of the enlarged inner diameter portion 160. The patch casing 500 is made to "deform" into an annular piece of casing by at least one retaining member such as an expandable internal ring 600 (FIG. 8). The expandable internal ring 600 is constructed and designed to temporarily expand the patch casing 500 to cover the enlarged inner diameter portion 160 of the housing 110. As shown in FIG. 6, no annular area is formed between the patch casing 500 and the enlarged inner diameter portion 160.

In operation, the patch casing 500 is inserted and aligned with the enlarged inner diameter portion 160 during assembly of the cement shoe assembly 100. The internal rings 600 are actuated and expanded, which forces the patch casing 500 to expand and cover the enlarged inner diameter portion 160. The installed patch casing 500 serves the same purpose as the sleeve 150 in previous embodiments and prevents the accumulation of unwanted materials in the enlarged inner diameter portion 160.

After cementing in a wellbore, the internal rings 600 are caused to collapse, thereby allowing the patch casing 500 to resume its original collapsed shape. FIG. 7 illustrates the patch casing 500 in a collapsed position. The rings 600 along with the patch casing 500 can be retrieved to the surface using retrieval tools that are well known in the art. Alternatively, the rings 600 can be drilled out causing the patch casing 500 to collapse and to be drilled through by the drill bit.

FIG. 8 is a section view of the patch casing 500 disposed at the enlarged inner diameter portion 160. The patch casing 500 is shown in the "deformed" or expanded state. The patch casing 500 is shown having at least two internal rings 600 at each end of the patch casing 500. In the deformed state, the patch casing 500 is able to cover the enlarged inner diameter portion 160 and prevents the accumulation of unwanted materials in annulus 155.

In addition to being used as described above, the sleeve can be used with any casing or tubular that has an enlarged inner diameter portion at an end that requires temporary protection of unwanted materials. Additionally, although the present invention has been described for use in hydrocarbon wells, it is also applicable to geothermal wells, injection wells, or any other type of well.

While the foregoing is directed to embodiments of the present invention, other and further embodiments of the invention may be devised without departing from the basic scope thereof, and the scope thereof is determined by the claims that follow.

The invention claimed is:

1. A shoe assembly for use in a borehole, comprising:

a tubing string having a tubular wall with longitudinal first and second sections, wherein the wall at the first section has a greater thickness than at the second section to define an internal recess along the second section;

a tapered nose portion extending from where the second section terminates, wherein the nose portion facilitates insertion of the shoe assembly in the borehole; and a sleeve coaxially disposed in the tubing string and extending from the tapered nose portion toward the first section, wherein the sleeve seals an annular area between the sleeve and the tubing string.

2. The shoe assembly of claim 1, wherein the annular area is filled to prevent accumulation of unwanted material in the annular area.

3. The shoe assembly of claim 1, wherein the annular area is filled with a fluid.

4. The shoe assembly of claim 1, wherein the tubing string is cemented in the borehole.

5. The shoe assembly of claim 1, wherein the first and second sections are surrounded by cement.

6. The shoe assembly of claim 1, wherein a constant inner diameter is defined by the sleeve and the first section.

7. The shoe assembly of claim 1, further comprising a valve disposed within the tubing string.

8. The shoe assembly of claim 1, wherein the sleeve extends from the nose portion to the first section.

9. A shoe assembly for use in a borehole, comprising:

a tubing string having a tubular wall with longitudinal first and second sections, wherein the wall at the first section has a greater thickness than at the second section to define an internal recess along the second section;

a tapered nose portion extending from where the second section terminates, wherein the nose portion facilitates insertion of the shoe assembly in the borehole; and a sleeve disposed in the tubing string such that the sleeve is drillable to permit removal of the sleeve from the second section that remains, wherein the sleeve forms a seal to prevent accumulation of unwanted materials in the second section.

10. The shoe assembly of claim 9, wherein the sleeve comprises a patch casing having a collapsed position and an expanded position temporarily maintained by internal rings.

11. The shoe assembly of claim 9, further comprising a valve disposed within the tubing string.

12. A shoe assembly for use in a borehole, comprising:

a tubing string having a tubular wall with longitudinal first and second sections, wherein the wall at the first section has a greater thickness than at the second section to define an internal recess along the second section; and a tapered nose portion extending from where the second section terminates to facilitate insertion of the shoe assembly in the borehole, wherein the internal recess at the tapered nose portion is in a sealed area.

13. The shoe assembly of claim 12, wherein a sleeve is disposed in the tubing string to define the sealed area such that the sleeve is drillable to permit removal of the sleeve from the second section that remains.

14. The shoe assembly of claim 12, wherein a sleeve is coaxially disposed in the tubing string to define the sealed area between the sleeve and the tubing string.

15. The shoe assembly of claim 12, wherein the sealed area is filled to prevent accumulation of unwanted material in the sealed area.

16. The shoe assembly of claim 12, wherein the sealed area is filled with a fluid.

17. The shoe assembly of claim 12, wherein the tubing string is cemented in the borehole.

18. The shoe assembly of claim 12, wherein the first and second sections are surrounded by cement.

19. The shoe assembly of claim 12, further comprising a valve disposed within the tubing string.

20. The shoe assembly of claim 12, wherein the sealed area extends from the nose portion to the first section.

* * * * *